US005933679A

United States Patent [19]

Palumbo

[11] Patent Number: 5,933,679

[45] Date of Patent: Aug. 3, 1999

[54] ELECTRONICALLY CONTROLLED PRINTING MACHINE OUTPUT RATE CONTROL SYSTEM

[75] Inventor: Stephen A. Palumbo, Hilton, N.Y.

[73] Assignee: Xerox Corporation, Stamford, Conn.

[21] Appl. No.: 09/049,816

[22] Filed: Mar. 27, 1998

[51] Int. Cl.[6] ..... G03G 15/00

[52] U.S. Cl. ..... 399/43; 358/296; 399/76

[58] Field of Search ..... 399/43, 66, 76, 399/77, 82, 83; 358/296, 401, 468

[56] References Cited

U.S. PATENT DOCUMENTS

| | | | |
|---|---|---|---|
| 4,588,284 | 5/1986 | Federico et al. | 399/76 |
| 5,021,829 | 6/1991 | Johnson et al. | 399/303 |
| 5,281,998 | 1/1994 | Douglas et al. | 399/84 |
| 5,319,464 | 6/1994 | Douglas et al. | 358/296 |
| 5,363,175 | 11/1994 | Matysek | 399/77 |
| 5,422,705 | 6/1995 | Omelchenko et al. | 399/43 |
| 5,455,656 | 10/1995 | Covert et al. | 399/77 X |
| 5,506,660 | 4/1996 | Rabb et al. | 399/66 |
| 5,629,775 | 5/1997 | Platteter et al. | 358/296 |

*Primary Examiner*—Arthur T. Grimley
*Assistant Examiner*—Sophia S. Chen
*Attorney, Agent, or Firm*—John S. Wagley

[57] ABSTRACT

An apparatus for use in a printing machine including a member for storing a latent image thereon of a document is provided. The printing machine is adapted to produce a printed copy of the document on a substrate. The apparatus adjusts the printed copy output rate thereof. The apparatus includes a latent image generating device for generating the latent image of the document. The latent image generating device has a switch for initiating the generating the latent image of the document. The apparatus further includes an adjustable timer for setting an elapsed time between sequential generations of the latent image of the document and a controller for controlling the printed copy output rate of the printing machine. The controller is adapted to provide for a plurality of printed copy output rates based on the time elapsed between sequential generations of the latent image of the document.

12 Claims, 6 Drawing Sheets

ELECTRONICALLY CONTROLLED PRINTING MACHINE OUTPUT RATE CONTROL SYSTEM

The present invention relates to an electrophotographic printing machine. More particularly, the invention relates to feeding substrates through a printing machine at variable feed rates.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High speed copying machines are becoming increasingly popular. These machines have a capacity or output capacity of say, for example, over 60 copies per minute. These machines are able to use single cut sheets of paper of various size such as A4, 8½×11, or 8½×14 inch copy sheets. These machines may be of the light lens, xerographic machine or may be a printer with digital input. Single, cut sheet printing machines are now available at speeds around 200 cpm.

Printing machines include a large quantity of complex components which must be designed to operate as an efficient machine. Design, tooling and manufacturing costs make it desirable for manufacturers of copiers and printing machines to provide several machines based upon common machine components. In fact, to achieve maximum reliability and low cost machines with different printing capacities, a series of printing machines may be provided with very similar components and which utilize similar frames and subassemblies. The throughput or copy output of these machines may be varied to provide a multitude of offerings to the customer based upon need and marketplace considerations.

Further, when selecting the copy output rate for a machine compromises are made between throughput of the machine and the optimum velocity and spacing between the adjacent sheets within the copy machine. Spacing between the adjacent sheets, also known as the interdocument gap, may be increased to minimize paper jams but in doing so may reduce the output of the machine.

In prior art families of similar machines with different production rates, each of the different capacity machine offerings would require component changes including, for example, gear changes and motor changes to speed up and slow down the speed of the documents and copy substrates through the machines. As an alternative to the gear and motor changes, machines with skipped image frames or pitches may be used to provide various production output rates. The skipped pitches are an intentional skip or interruption of the flow of output sheets through the machine in the stream of sheets. This solution causes a non-uniform flow of sheets through the copy machines and while the production rate is decreased, the benefit to minimizing paper jams is not realized through this method.

The following disclosures relate to the area controlling the flow of sheets:

U.S. Pat. No. 5,629,775
Patentee: Platteter et al.
Issued: May 13, 1997

U.S. Pat. No. 5,506,660
Patentee: Rabb et al.
Issued: Apr. 9, 1996

U.S. Pat. No. 5,363,175
Patentee: Matysek
Issued: Nov. 8, 1994

U.S. Pat. No. 5,319,464
Patentee: Douglas et al.
Issued: Jun. 7, 1994

U.S. Pat. No. 5,281,998
Patentee: Douglas et al.
Issued: Jan. 25, 1994

U.S. Pat. No. 5,021,829
Patentee: Johnson et al.
Issued: Jun. 4, 1991

U.S. Pat. No. 4,588,284
Patentee: Federico et al.
Issued: May 13, 1986

The relevant portions of the foregoing disclosures may be briefly summarized as follows:

U.S. Pat. No. 5,629,775 discloses an electronic image processing apparatus having a marking machine, a source of copy sheets, a controller, and a plurality of resources wherein each of the resources includes an associated processor for storing data related to the operational timing of the associated resource. A bus interconnects the processors to the controller for directing the operation of the image processing apparatus to provide images on the copy sheets and the controller includes circuitry for interrogating each of the processors for the operational timing data and logic for responding to the operational timing data of each of the processors for dynamically configuring the controller to operate in accordance with the operational timing of the processors.

U.S. Pat. No. 5,506,660 discloses a method of intermingling images of different sizes on a photosensitive surface and yet avoid the seam of the photosensitive surface and synchronize the transfer of the images to intermingled copy sheets of various sizes by determining the size of each image before projecting the image onto the photosensitive surface; predicting the relationship of the image to the seam of the photosensitive surface; deciding that a given image would overlay the seam of the photosensitive surface, applying a timing adjustment to project the given image onto the photosensitive surface in avoidance of the seam of the photosensitive surface, and transferring each of the images including said given image from the photosensitive surface to copy sheets whereby images of different sizes are intermingled along the photosensitive surface and copy sheets of different sizes are intermingled along the copy sheet path.

U.S. Pat. No. 5,363,175 discloses a plurality of image processing resources including a finishing station provides an image on a copy sheet during a given cyclical time period and a controller sequencer electrically interconnected to each of the resources directs the operation of the image processing resources, wherein the sequencer provides concurrent ready request signals to each of the resources including the finishing stations, each of the resources provide ready or not ready response signals to the sequencer, and dependent upon the ready or not ready signals of each of the resources the controller periodically skips cyclical time periods or pitches to allow the resources to synchronously reach a ready state.

U.S. Pat. No. 5,319,464 discloses a system for providing a memory for storing electronic images with color mode marks and a control for providing images in optional color modes for producing a set of images with discrete elements of the set of images processed in a selected color mode independent of the color mode other elements. This is accomplished by identifying elements of the set of images with color code marks and responding to the color code marks to alter the operation of the machine dependent upon the identified color mode mark. The machine pitches are also changed to provide additional features such as simplex and duplex mode to selected images.

U.S. Pat. No. 5,281,998 discloses a system for providing a memory for storing electronic images with color mode marks and a control for providing images in optional color modes for producing a set of images with discrete elements of the set of images processed in a selected color mode independent of the color mode other elements. This is accomplished by identifying elements of the set of images with color code marks and responding to the color code marks to alter the operation of the machine dependent upon the identified color mode mark. The machine pitches are also changed to provide additional features such as simplex and duplex mode to selected images.

U.S. Pat. No. 5,021,829 discloses a multicolor image forming apparatus which includes an image forming drum which has a gap or though in its periphery used for securing the ends of a photoconductive sheet. A transfer roller engages the drum to receive a series of different color toner images in registration to form a multicolor image. The transfer roller is driven by engagement with the periphery of the drum in a pressure nip between the drum and roller. When the gap in the drum passes through the nip, an independent motor rotates the transfer roller to a home position, thereby reindexing the roller between each series of images.

U.S. Pat. No. 4,588,284 discloses a control system is provided to automatically alter the control of a machine to respond to a different number of pitches or images that the machine can manage at one time. A flag in memory is monitored and in response to the flag, the machine control is adjusted to manage a different number of pitches during the operation of the machine and to provide clock signals for the timed actuation of events in each of the pitches.

In accordance with one aspect of the invention, there is provided an apparatus for use in a printing machine including a member for storing a latent image thereon of a document. The printing machine is adapted to produce a printed copy of the document on a substrate. The apparatus adjusts the printed copy output rate thereof. The apparatus includes a latent image generating device for generating the latent image of the document. The apparatus further includes a switch for initiating the generating of the latent image of the document. The apparatus further includes an adjustable timer for setting an elapsed time between sequential generations of the latent image of the document and a controller for controlling the printed copy output rate of the printing machine. The controller is adapted to provide for a plurality of printed copy output rates based on the time elapsed between sequential generations of the latent image of the document.

In accordance with another aspect of the present invention, there is provided a printing machine including an apparatus for adjusting the printed copy output rate thereof. The printing machine includes a member for storing a latent image thereon of a document. The printing machine is adapted to produce a printed copy of the document on a substrate. The apparatus is used to adjust the printed copy output rate. The apparatus includes a latent image generating device for generating the latent image of the document. The apparatus further includes a switch for initiating the generating of the latent image of the document. The apparatus further includes an adjustable timer for setting an elapsed time between sequential generations of the latent image of the document and a controller for controlling the printed copy output rate of the printing machine. The controller is adapted to provide for a plurality of printed copy output rates based on the time elapsed between sequential generations of the latent image of the document.

In accordance with yet another aspect of the present invention, there is provided a method for providing printed copies of a document from a printing machine at a plurality of printed copy output rates of the printed copies. The method includes the step of inputting a value indicative of one of a plurality of printed copy output rates into a register within the printing machine. The method further includes the steps of generating a first latent image of a first document on a member and advancing the member. The method further includes the step of delaying the generating of a second latent image of one of the first document and a second document on the member for a period of time corresponding to the value indicative of the one of the plurality of printed copy output rates member. The method further includes the step of generating the second latent image, whereby the printed copy output rate is based on the time elapsed between sequential generations of the latent image of the document.

For a general understanding of the present invention, as well as other aspects thereof, reference is made to the following description and drawings, in which like reference numerals are used to refer to like elements, and wherein.

It is, therefore, apparent that there has been provided in accordance with the present invention, an output rate control system that fully satisfies the aims and advantages hereinbefore set forth.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Inasmuch as the art of electrostatographic processing is well known, the various processing stations employed in a typical electrostatographic copying or printing machine of the present invention will initially be described briefly with reference to FIG. 1. It will become apparent from the following discussion that the output rate control system of the present invention is equally well suited for use in a wide variety of other electrophotographic or electronic printing systems, as for example, ink jet, ionographic, laser based exposure systems, etc.

Figure 3:
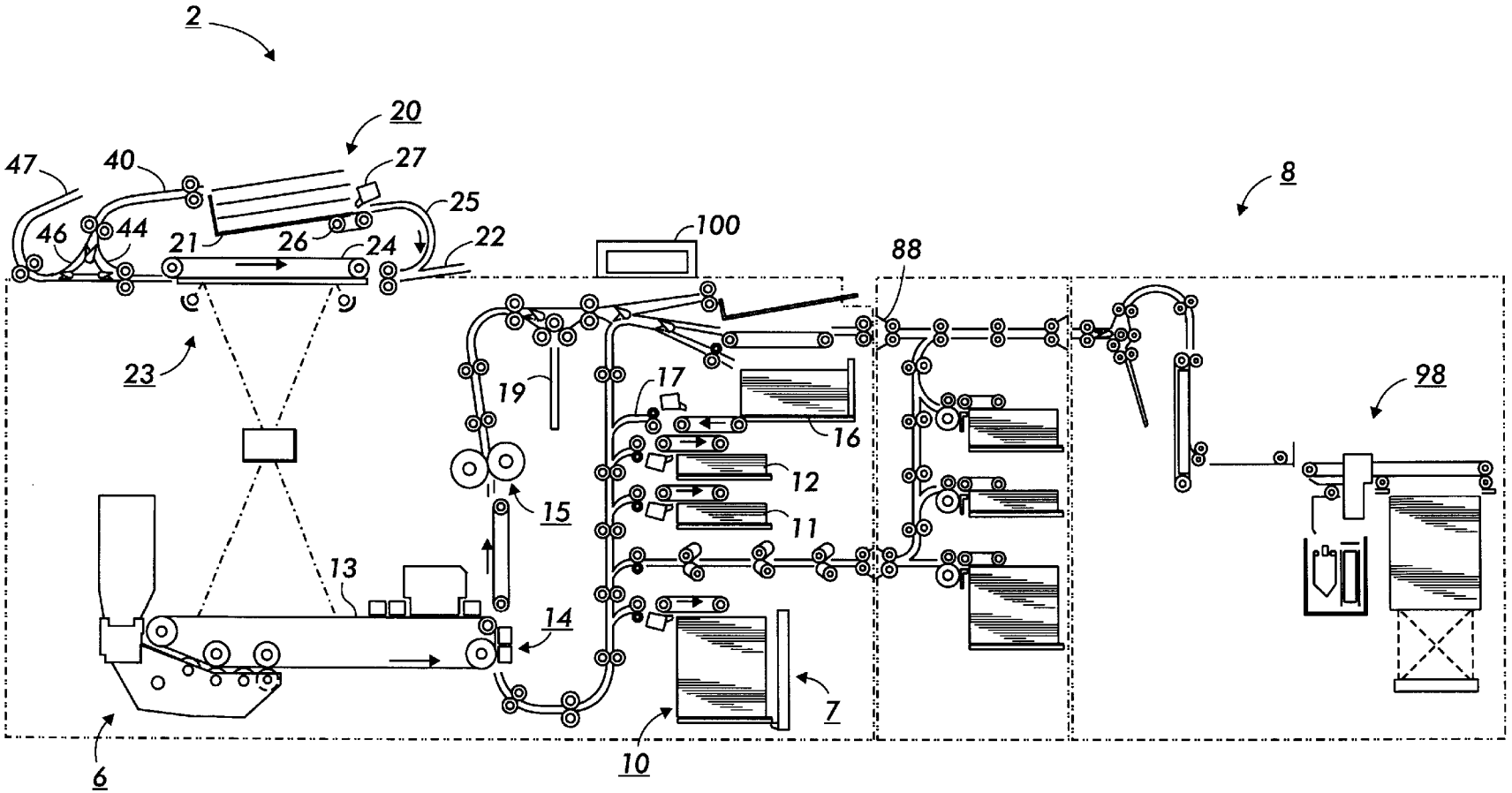
FIG. 3 is a schematic view illustrating the principal mechanical components and paper path of the printing system incorporating the output rate control system of the present invention.

In FIG. 3, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 3 incorporates a recirculating document handler (RDH) 20 of a generally known type, which may be found, for example, in the well known Xerox Corporation models "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated print sets from either duplex or simplex original documents circulated by a document handler. As is conventionally practiced, the entire document handler unit 20 may be pivotally mounted to the copier so as to be liftable by an operator for alternative manual document placement and copying. In this manner, the exemplary printing system or apparatus 2 is designed to receive input documents as manually positioned on an optically transparent platen or automatically positioned thereon via a document handler, such as a recirculating document handler (RDH) 20, via a document handler input tray 21 or a document feeder slot 22.

The RDH 20 operates to automatically transport individual registered and spaced document sheets into an imaging station 23, platen operatively associated with the xerographic processing section 6. A platen transport system 24 is also provided, which may be incrementally driven via a non-slip or vacuum belt system controlled by a system controller 100 for stopping the document at a desired registration (copying) position in a manner taught by various references known in the art.

The RDH 20 has a conventional "racetrack" document loop path configuration, which preferably includes generally known inverting and non-inverting return recirculation paths for transporting original input documents back to the RDH loading and restacking tray 21. An exemplary set of duplex document sheets is shown stacked in this document tray 21. For clarity, the illustrated document and copy sheets are drawn here with exaggerated spacing between the sheets being stacked; in actual operation, these stacked sheets would be directly superposed upon one another. The RDH 20 may be a conventional dual input document handler, having an alternative semiautomatic document handling (SADH) side loading slot 22.

Documents may be fed to the same imaging station 23 and transported by the same platen transport belt 24 from either the SADH input slot 22 at one side of the RDH 20, or from the regular RDH input, namely the loading or stacking tray 21, situated on top of the RDH unit. While the side loading slot 22 is referred to herein as the SADH feeding input slot 22, this input feeder is not limited to semi-automatic or "stream feed" document input feeding, but is also known to be usable for special "job interrupt" insert jobs. Normal RDH document feeding input comes from the bottom of the stack in tray 21 through arcuate, inverting RDH input path 25 to the upstream end of the platen transport 24. Input path 25 preferably includes a known "stack bottom" corrugated feeder-separator belt 26 and air knife 27 system including, document position sensors (not shown), and a set of turn baffles and feed rollers for inverting the incoming original documents prior to imaging.

Document inverting or non-inverting by the RDH 20 is further described, for example, in U.S. Pat. Nos. 4,794,429 or 4,731,637, among others. Briefly, input documents are typically exposed to a light source on the platen imaging station 23, or fed across the platen without being exposed, after which the documents may be ejected by the platen transport system 24 into downstream or off-platen rollers and further transported past a gate or a series of gates and sensors. Depending on the position of these gates, the documents are either guided directly to a document output path and then to a catch tray, or, more commonly, the documents are deflected past an additional sensor, and into an RDH return path 40. The RDH return path 40 provides a path for leading the documents back to tray 21 so that a document set can be continually recirculated.

This RDH return path 40 includes reversible rollers to provide a choice of two different return paths to the RDH tray 21: a simplex return path 44 which provides sheet or document inversion or a reversible duplex return path 46 which provides no inversion, as will be further explained. For the duplex path 46, the reversible rollers are reversed to reverse feed the previous trail edge of the sheet back into the duplex return path 46 from an inverter chute 47. This duplex return path 46 provides for the desired inversion of duplex documents in one circulation as they are returned to the tray 21, for copying opposite sides of these documents in a subsequent circulation or circulations, as described in the above cited art.

Typically, the RDH inverter and inversion path 46, 47 are used only for documents loaded in the RDH input tray 21 and for duplex documents. In normal operation, a duplex document has only one inversion per circulation (occurring in the RDH input path 25). By contrast, in the simplex circulation path there are two inversions per circulation, one in each of the paths 24 and 44, whereby two inversions per circulation is equivalent to no inversion such that simplex documents are returned to tray 21 in their original (face up) orientation via the simplex path 44.

The entire stack of originals in the RDH tray 21 can be recirculated and copied to produce a plurality of collated copy sets. In addition, the document set or stack may be recirculated through the RDH any number of times in order to produce any desired number of collated duplex print sets; that is, collated sets of duplex copy sheets, in accordance with various instruction sets known as print jobs which can be programmed into a controller 100, to operator which will be described.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets can be stored and delivered to the xerographic processing section 6 via auxiliary paper trays 11 or 12 which may be provided in an independent or stand alone device coupled to the electrophotographic printing system 2.

After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

All document handler, xerographic imaging sheet feeding and finishing operations are preferably controlled by a generally conventional programmable controller 100. The controller 100 is additionally programmed with certain novel functions and graphic user interface features for the general operation of the electrostatographic printing system 2 and the dual path paper feeder of the present invention. The controller 100 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc.

As further taught in the references, the controller 100 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 100 may be conventionally connected to receive and act upon jam, timing, positional and other control signals from various sheet sensors in the document recirculation paths and the copy sheet paths. In addition, the controller 100 can preferably automatically actuate and regulate the positions of sheet path selection gates, including those gates associated with the dual path paper feeder, depending upon the mode of operation selected by the operator and the status of copying in that mode.

It shall be understood from the above description that multiple print jobs, once programmed, are scanned and printed and finished under the overall control of the machine controller 100. The controller 100 controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device 98. The printer controller 100 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

Figure 6:
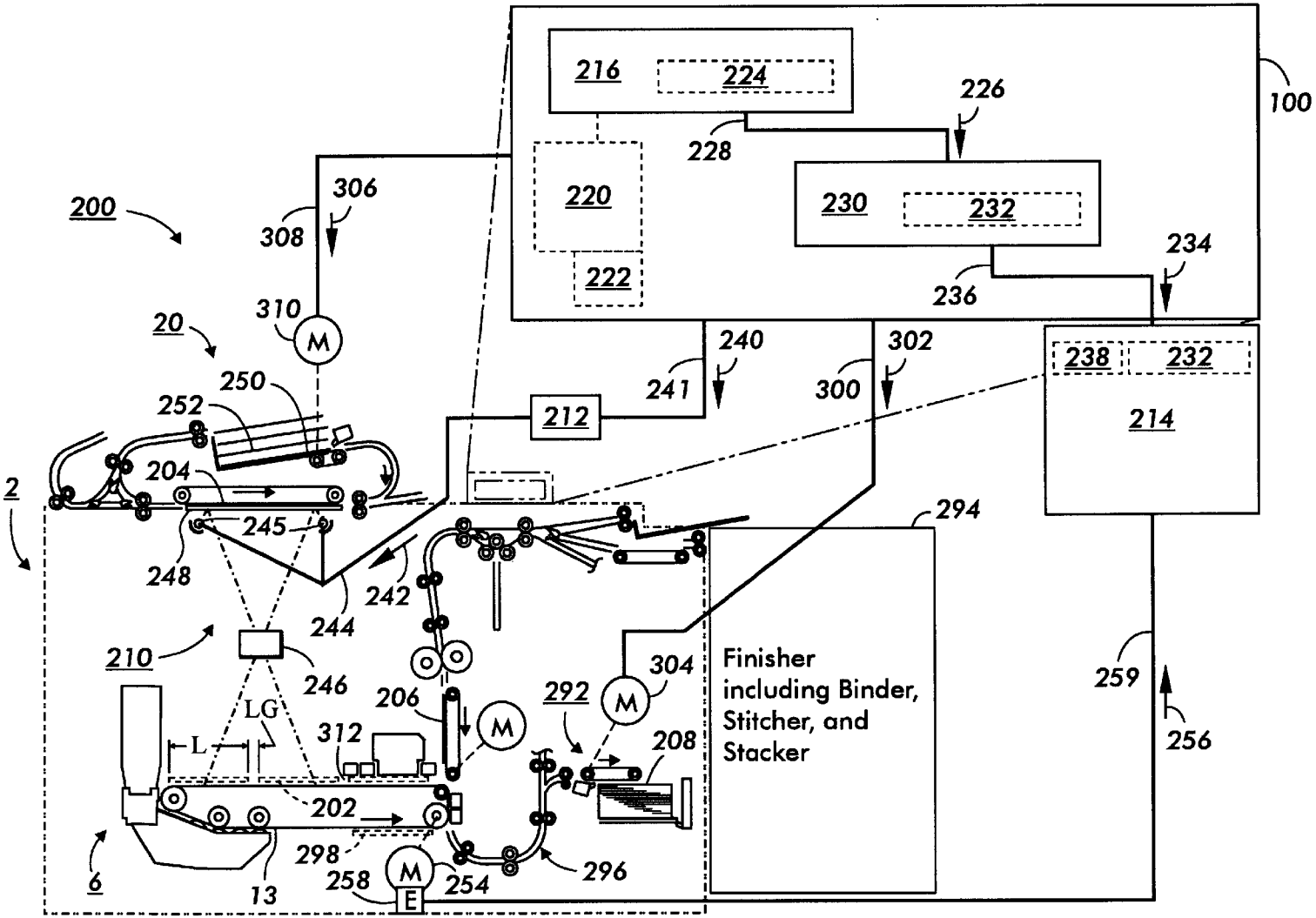
FIG. 6 is a schematic view of an apparatus for use in a printing machine incorporating the output rate control system of the present invention.

According to the present invention and referring to FIG. 6, apparatus 200 is shown which utilizes the electronically controlled printing machine output rate control system of the present invention. The apparatus 200 is utilized in printing machine 2. The printing machine 2 includes a member 13 in the form of a photoconductive belt which stores latent image 202 of a document 204. The printing machine 2 is adapted to produce a printed copy 206 of the document 204 on a substrate 208. The apparatus 200 is utilized to adjust the printed copy output rate of the printed copy 206. The apparatus 200 includes a latent image generating device 210 for generating the latent image 202 of the document 204.

The apparatus 200 further includes a switch 212 for setting an elapsed time between sequential generations of the latent image 202 of the document 204. The apparatus 200 further includes controller 100 for controlling the printed copy output rate of the printing machine 2. The controller 100 is adapted to provide for a plurality of printed copy output rates based on the elapsed time between sequential generations of the latent image 202 of the document 204. The apparatus 200 also includes an adjustable timer 214 for setting an elapsed time between sequential generations of the latent image 202 of the document 204.

The controller 100 may be any suitable device capable of storing and processing controlling information for the printing machine 2. The controller 100 may be in the form of a programmable controller or in the form of a computer. The controller 100 may include a plurality of integrated circuits and other electronics necessary to properly control the machine 2. The controller 100 preferably includes a register 216 in the form of an addressable register, i.e. the register 216 may be located within a semiconductor device (not shown) which includes programmable memory. The register 216 preferably is addressable only by the machine logic within the printing machine 200.

It should be appreciated that alternatively the register 216 of the controller 100 may be connectable to a control 220 shown in phantom which may be used to select a particular printed copy output rate by selecting one of several buttons on the control 220 or by inputting the printed copy output rate on a touchpad (not shown) located on the control 220. The control 220 may also include a display 222 shown in phantom which will show the current printed copy output rate.

The register 216 may include a printer copy output rate 224 and may transmit a signal 226 through conduit 228 to a converter 230 within the controller 100 which converts the printer capacity output rate to a corresponding delay time 232. The time 232 is indicative of the delay time between successive sheets necessary to correspond to the printer copy output rate 224. The converter 230 may send a signal 234 corresponding to the delay time 232 through conduit 236 to adjustable timer 214. The adjustable timer 214 may compare the delay time 232 to an elapsed time 238 indicative of the elapsed time between sequential generations of the latent image of the document.

The timer 214 may be any suitable timer capable of calculating the elapsed time 238. The timer 214 may be mechanical, but preferably is an electrical device. The timer 214 may be any suitable device capable of initiating the latent image generating device to generate the latent image.

Preferably the timer 214 may utilize pulses 256 from rotary encoder 258 located on motor 254 utilized to drive the photoconductor belt 13. The pulses 256 are sent uniformly with respect to time and serve as clock ticks to time the operation of the machine 2. The pulses 258 are sent by conduit 259 to the timer 214 to be converted into elapsed time 238 in the timer 214 of the controller 100. The switch 212 may be mechanical, but preferably, is an electrical device.

Preferably, when the elapsed time 238 equals the delay time 232, a signal 240 is sent to switch 212 either directly from the adjustable timer 214 or through the controller 100 and conduit 241. The signal 240 is used at the switch 212 to initiate the generation of the latent image of the document at the latent image generating device 210. The switch 212 thus sends signal 242 via conduit 244 to the latent image generating device 210 initiating the generation of the latent image 202 of the document 204.

The latent image generating device 210 may be any suitable device capable of generating a latent image, i.e. the latent image generating device may be a raster output scanner (ROS) capable of generating a latent image from an electronic signal or in the form of a light lens illuminating device. For example, the latent image generating device 210 may include an illuminating lamp or lamps 245 which cooperate with optic components 246 and platen 248 to generate the latent image 202. The illuminating device may be a diode or any high energy illuminating source capable of rapid illumination or flashing. While the latent image generating device 210 may scan or traverse the document 204, preferably the latent image generating device 210 flash illuminates the entire document 204 instantaneously such that the latent image 202 is exposed totally and simultaneously such that the period of time for the exposing of the latent 202 is substantially instantaneous.

Preferably, the printing machine 2 further includes a document feeder 20 for advancing the document 204 toward the platen 248. The document feeder 20 is shown in greater detail in FIG. 3.

Referring again to FIG. 6, the document feeder 20 preferably has a document feed rate independent of the elapsed time between sequential generations of the latent image 202 of the document 204. The document feeder 20 advances a first document 250 away from the platen 248 and advances a second document 252 toward the platen 248 subsequent to the generation of the latent image 202 of the first document 250.

Preferably, the printing machine also includes development unit 6 for developing the latent image 202 with marking particle (not shown) to be transferred onto the substrates 208 to form the printed copy 206.

Preferably, the printing machine 2 also includes member driver 254 in the form of a motor for advancing the photoconductive drum 13. The motor 254 preferably has a feed rate independent of the elapsed time between sequential generations of the latent image 202 of the document 204.

Figure 4:
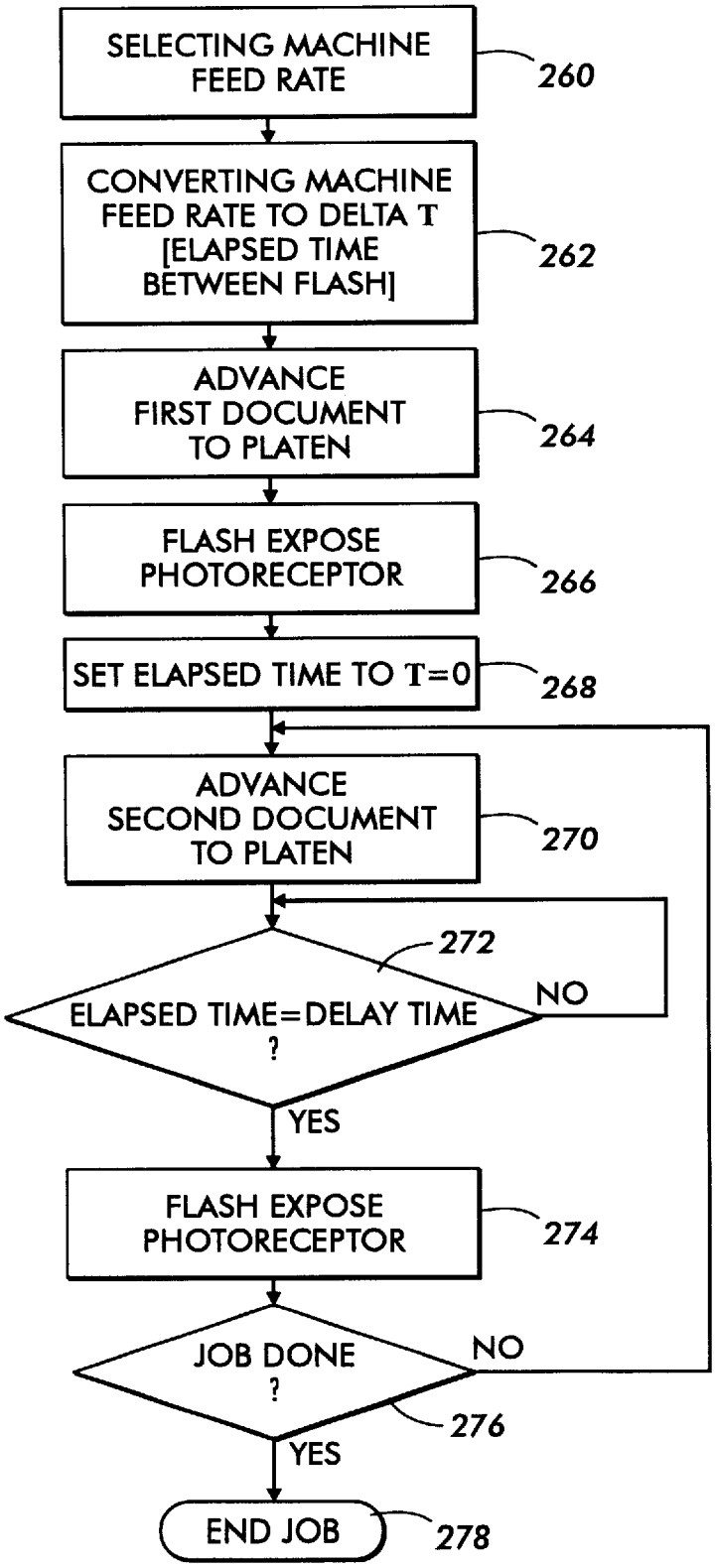
FIG. 4 is a schematic view of a flow chart of the method of varying the output of the machine according to the present invention.

Referring now to FIG. 4, a flow chart is shown which explains the operation of the apparatus 200. The operation of apparatus 200 includes selecting the machine feed rate as shown in block 260. Once the machine feed rate is selected, the machine feed rate is converted to a $\Delta T$ or elapsed time between flashes of the illumination lamp 242 (see FIG. 6) as shown in block 262. After the feed rate is converted to an elapsed time between flashes, first document 250 is advanced toward platen 248 (see FIG. 6) as shown on block 264. After the first document has been advanced to platen 248, the photoconductor 13 is exposed by flash lamp 242 (see FIG. 6) as described at block 266.

After the photoconductor has been exposed, the time within the adjustable timer 214 (see FIG. 6) is set to zero as described in block 268. After the time is set to zero, the second document 252 (see FIG. 6) is advanced toward platen 248 as described in block 270. After the second document 252 is advanced, elapsed time 238 is compared to the delay time 232 in the adjustable timer 214 as shown as decision block 272.

When the elapsed time reaches the delay time, the photoreceptor belt 13 is flash exposed by lamp 242 (see FIG. 6) as shown at block 274. After the photoconductor 13 is flash exposed, decision block 276 determines whether the printing job is finished. If the printing job is finished, end job block 278 is reached. If the job is not done, the flow chart of FIG. 4 shows that a subsequent document is advanced to platen as shown in decision block 270. The flow chart of FIG. 4 continues until the job is done.

Figure 5:
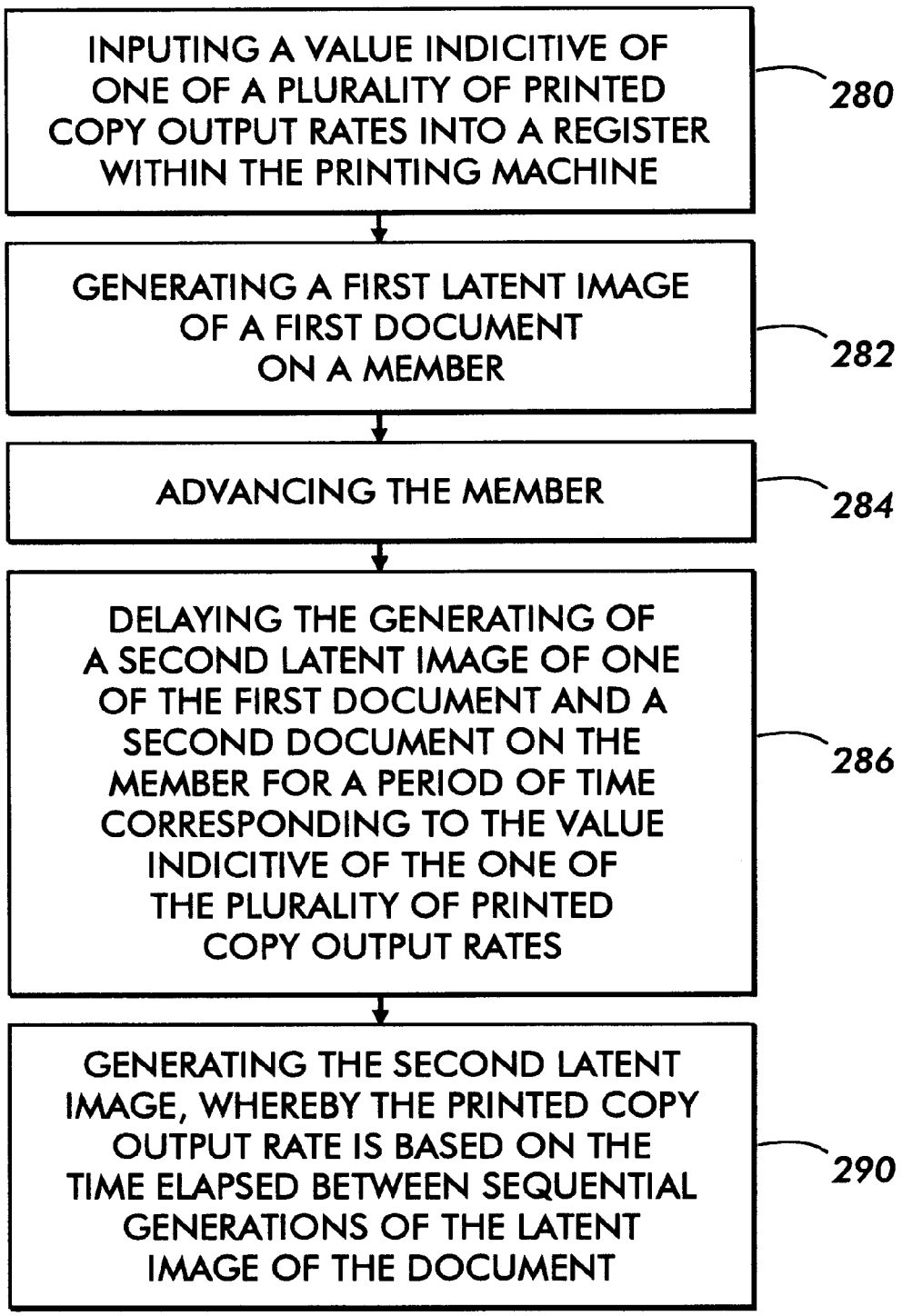
FIG. 5 is a schematic chart of the method of varying the output of the machine according to the present invention.

Referring now to FIG. 5, a method of controlling a printing machine output rate according to the present invention is described. The method includes first step 280 of inputting a value indicative of one of a plurality of printed copy output rates into a register within the printing machine. After step 280, a first latent image is generated of a first document on a member as shown in step 282. After step 282, the member is advanced as shown in step 284. After step 284 the step of delaying the generation of a second latent image of one of the first document and the second document on the member for a period of time corresponding to the value indicative of the one of the plurality of printed copy output rates is shown as step 286. After step 286, the step of generating the second latent image is performed whereby the printed copy output rate is based on the time elapsed between sequential generations of latent image of the document as shown in step 290.

In summary and referring again to FIG. 6, the apparatus 200 serves to provide for a printing machine 2 with an adjustable output rate which includes a document handler 20 which has a constant feed rate for any selected output rate of the printing machine. The printing machine 2 also includes a substrate feed system 292 and a copy output feed system 294 which have feed rates independent of the copy output rate selected for the machine.

It should be appreciated, however, while the substrate feed system 292 feed rate and the document feeder 20 feed rate remain constant regardless of the copy output rate, the substrate 208 and the document 204 must be fed through the printing machine 2 in a timed relationship such that the document 204 must be presented to the platen 246 in a timed relationship such that the latent image 202 from the document 204 travels past the development unit 6 and toward transfer position 296 such that the substrate 208 may be matched with developed image 298 to form the copy 206.

To accomplish this timed relationship, the controller 100 preferably sends signal 300 through conduit 302 to the substrate feed system 292 in a timed relationship to energize substrate feed motor 304 such that the substrate 208 arrives in a timed relationship.

Further, the controller 100 sends a document feeder signal 306 through conduit 308 to document feeder motor 310 in a timed relationship such that the motor 310 is energized in the proper timed relationship to send document 204 to the platen 248 in a timed relationship such that the latent image 202 arrives to meet the substrate 208 in a timed relationship.

Since the motor 254 rotating the photoconductive belt 13 operates at a constant speed independent of the print copy output rate, the belt 13 travels at a uniform velocity. Since the lamp 245 serves to expose the entire document 204 upon the energizing of the latent image generating device 210, the latent image 202 has a length L independent of the printer copy output rate. Since the consecutive latent images must not overlap, an interdocument gap 312 is positioned between adjacent latent images 202. Since the velocity of the belt 13 remains a constant, the interdocument gap 312 has a length LG which increases as the print copy output rate decreases.

Figure 1A:
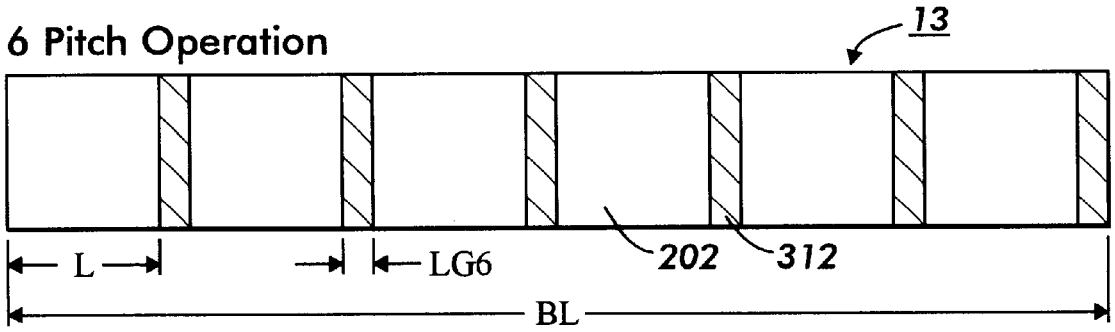
FIG. 1A is a top view of a photoreceptor belt showing exposed and non-exposed areas for a 6 pitch mode of operation.

Referring now to FIG. 1A, the photoreceptor belt 13 is shown in a cut and stretched out configuration. For example, as shown in FIG. 1A, the belt 13 has a length BL which includes six pitches or six latent image 202*s* and six interdocument gaps 312. Thus, the belt 13 has a length BL which is equal to 6×L+6×LG6. While it should be appreciated that the number of pitches or the number of latent images that may be fitted onto a belt does not need to be a whole number, latent image layouts for a 6 pitch, 5 pitch and 4 pitch operation are shown respectively in FIGS. 1A–1C.

Figure 1B:
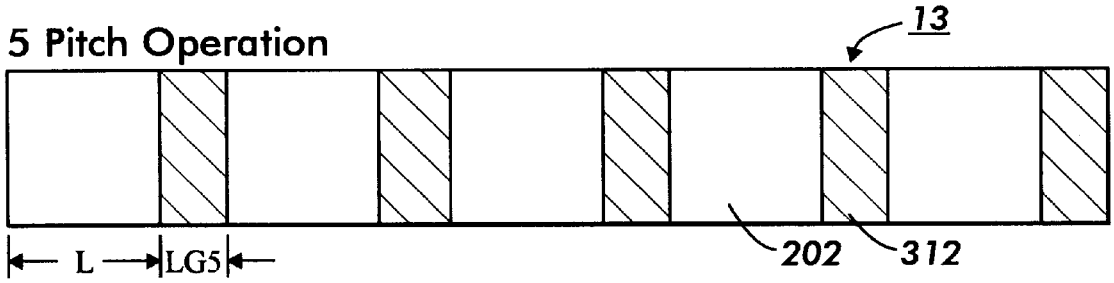
FIG. 1B is a top view of a photoreceptor belt showing exposed and non-exposed areas for a 5 pitch mode of operation.
Figure 1C:
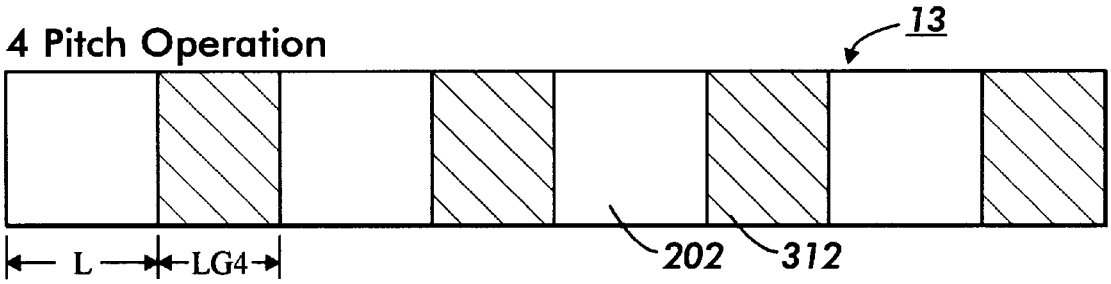
FIG. 1C is a top view of a photoreceptor belt showing exposed and non-exposed areas for a 4 pitch mode of operation.
Figure 2:
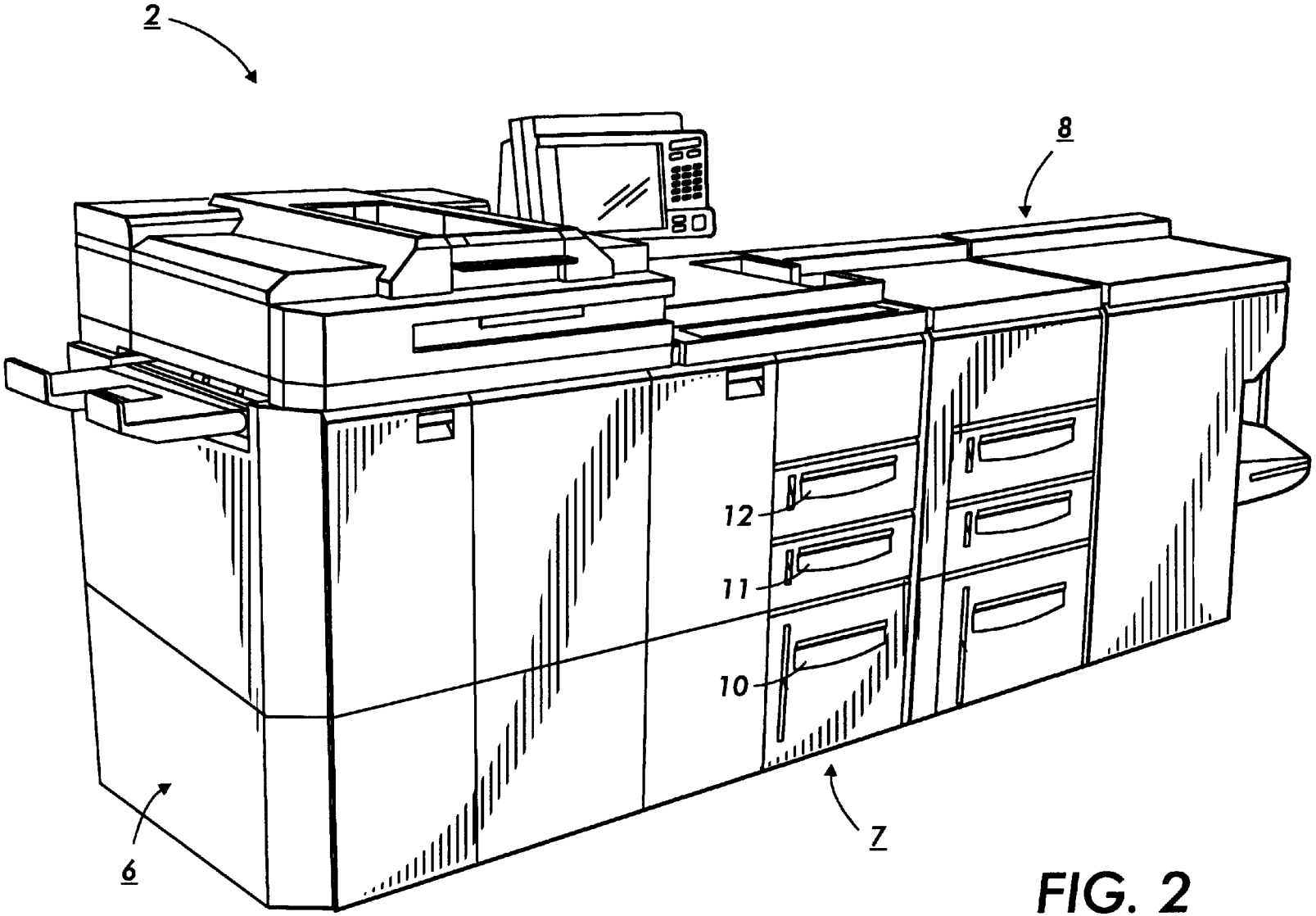
FIG. 2 is a perspective view of the electronic printing system of FIG. 1.

Referring to FIGS. 1A–1C, the length L of the latent images 202 of the belt 13 is identical for the 4, 5, and 6 pitch operations. It should be appreciated that the interdocument gap length LG5 of the 5 pitch operation of FIG. 1B is greater than the interdocument gap length LG6 of the 6 pitch operation. Furthermore, the interdocument gap length LG4 of the 4 pitch operation is even greater than the length LG5 of the 5 pitch operation.

Referring to FIGS. 1A through 1C, it is easy to understand that as the printing machine is slowed from the six pitch operation of FIG. 1A through the four pitch operation of FIG. 1C, the interdocument gap 312 becomes increasingly wider. Thus, the space between adjacent sheets in the copy feed system 294 becomes increasingly larger. Thus, as the machine is operated at slower output rates, the interdocument gap becomes larger reducing the occurrence of jams within the printing machine.

Also by referring to FIGS. 1A through 1C, it is clear that the time between adjacent output sheets remains the same as the interdocument gap within the 4, 5 and 6 pitch operations is constant.

By providing an electronically controlled printing machine output rate control system, the throughput of the printing machine may be modified without the need for gears or motors.

By providing an electronically controlled printing machine output rate which provides for varying the interdocument gap and even uniform flow of sheets from the printing machine may be had at a variety of throughput rates.

By providing an electronically controlled printing machine output rate control system which provides for varying the interdocument gap at various feed rates skip pitches otherwise utilized to adjust the throughput may be avoided.

By providing an electronically controlled printing machine output rate control system whereby the interdocument gap may be varied in a virtually infinitely variable output rate may be provided for the machine.

By providing an electronically controlled printing machine output rate control system for a printing machine, the printing machine output rate may be modified without requiring any hardware or mechanical changes to the machine.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for use in a printing machine including a member for storing a latent image thereon of a document, the printing machine adapted to produce a printed copy of the document on a substrate, said apparatus for adjusting the printed copy output rate thereof, said apparatus comprising:

a latent image generating device for generating the latent image of the document;

a switch for initiating the generating the latent image of the document;

an adjustable timer for setting an elapsed time between sequential generations of the latent image of the document; and a controller for controlling the printed copy output rate of the printing machine, said controller adapted to provide for a plurality of printed copy output rates based on the time elapsed between sequential generations of the latent image of the document, wherein at least two of the plurality of printed copy output rates having relative speed ratios thereof corresponding to a number of latent images simultaneously applied onto the member.

2. An apparatus for use in a printing machine including a member for storing a latent image thereon of a document, the printing machine adapted to produce a printed copy of the document on a substrate, said apparatus for adjusting the printed copy output rate thereof, said apparatus comprising:

a latent image generating device for generating the latent image of the document;

a switch for initiating the generating the latent image of the document;

an adjustable timer for setting an elapsed time between sequential generations of the latent image of the document; and a controller for controlling the printed copy output rate of the printing machine, said controller adapted to provide for a plurality of printed copy output rates based on the time elapsed between sequential generations of the latent image of the document, wherein time elapsed between sequential generations of the latent image of the document is substantially constant and latent images are spaced apart substantially equally about the member.

3. An apparatus for use in a printing machine including a member for storing a latent image thereon of a document, the printing machine adapted to produce a printed copy of the document on a substrate, said apparatus for adjusting the printed copy output rate thereof, said apparatus comprising:

a latent image generating device for generating the latent image of the document;

a switch for initiating the generating the latent image of the document;

an adjustable timer for setting an elapsed time between sequential generations of the latent image of the document;

a controller for controlling the printed copy output rate of the printing machine, said controller adapted to provide for a plurality of printed copy output rates based on the time elapsed between sequential generations of the latent image of the document; and an addressable register operably associated with said controller and said timer, said register adapted for selecting one of the plurality of printed copy output rates.

4. The apparatus of claim 3:

wherein said controller includes a semiconductor device having programmable memory; and wherein said register is located within said semiconductor device.

5. An apparatus for use in a printing machine including a member for storing a latent image thereon of a document, the printing machine adapted to produce a printed copy of the document on a substrate, said apparatus for adjusting the printed copy output rate thereof, said apparatus comprising:

a latent image generating device for generating the latent image of the document;

a switch for initiating the generating the latent image of the document;

an adjustable timer for setting an elapsed time between sequential generations of the latent image of the document; and a controller for controlling the printed copy output rate of the printing machine, said controller adapted to provide for a plurality of printed copy output rates based on the time elapsed between sequential generations of the latent image of the document, wherein said latent image generating device is adapted to generate the latent image of the document substantially instantaneously so that the printed copy output rate is substantially based solely on the elapsed time between sequential generations of the latent image of the document.

6. A printing machine including an apparatus for adjusting the printed copy output rate thereof, the printing machine including a member for storing a latent image thereon of a document, the printing machine adapted to produce a printed copy of the document on a substrate, said apparatus for adjusting the printed copy output rate thereof, said apparatus comprising:

a latent image generating device for generating the latent image of the document;

a switch for initiating the generating the latent image of the document;

an adjustable timer for setting an elapsed time between sequential generations of the latent image of the document; and a controller for controlling the printed copy output rate of the printing machine, said controller adapted to provide for a plurality of printed copy output rates based on the time elapsed between sequential generations of the latent image of the document, wherein at least two of the plurality of printed copy output rates having relative speed ratios thereof corresponding to a number of latent images simultaneously applied onto the member.

7. A printing machine including an apparatus for adjusting the printed copy output rate thereof, the printing machine including a member for storing a latent image thereon of a document, the printing machine adapted to produce a printed copy of the document on a substrate, said apparatus for adjusting the printed copy output rate thereof, said apparatus comprising:

a latent image generating device for generating the latent image of the document;

a switch for initiating the generating the latent image of the document;

an adjustable timer for setting an elapsed time between sequential generations of the latent image of the document; and a controller for controlling the printed copy output rate of the printing machine, said controller adapted to provide for a plurality of printed copy output rates based on the time elapsed between sequential generations of the latent image of the document, wherein time elapsed between sequential generations of the latent image of the document is substantially constant and latent images are spaced apart substantially equally about the member.

8. A printing machine including an apparatus for adjusting the printed copy output rate thereof, the printing machine including a member for storing a latent image thereon of a document, the printing machine adapted to produce a printed copy of the document on a substrate, said apparatus for adjusting the printed copy output rate thereof, said apparatus comprising:

a latent image generating device for generating the latent image of the document;

a switch for initiating the generating the latent image of the document;

an adjustable timer for setting an elapsed time between sequential generations of the latent image of the document; and a controller for controlling the printed copy output rate of the printing machine, said controller adapted to provide for a plurality of printed copy output rates based on the time elapsed between sequential generations of the latent image of the document; and an addressable register operably associated with said controller and said timer, said register adapted for selecting one of the plurality of printed copy output rates.

9. The printing machine of claim 8:

wherein said controller includes a semiconductor device having programmable memory; and wherein said register is located within said semiconductor device.

10. A printing machine including an apparatus for adjusting the printed copy output rate thereof, the printing machine including a member for storing a latent image thereon of a document, the printing machine adapted to produce a printed copy of the document on a substrate, said apparatus for adjusting the printed copy output rate thereof, said apparatus comprising:

a latent image generating device for generating the latent image of the document;

a switch for initiating the generating the latent image of the document;

an adjustable timer for setting an elapsed time between sequential generations of the latent image of the document; and a controller for controlling the printed copy output rate of the printing machine, said controller adapted to provide for a plurality of printed copy output rates based on the time elapsed between sequential generations of the latent image of the document, wherein said latent image generating device is adapted to generate the latent image of the document substantially instantaneously so that the printed copy output rate is substantially based solely on the elapsed time between sequential generations of the latent image of the document.

11. A method of providing printed copies of a document from a printing machine at a plurality of printed copy output rates of the printed copies, the method comprising the steps of:

inputting a value indicative of one of the plurality of printed copy output rates into a register within the printing machine;

generating a first latent image of a first document on a member;

advancing the member;

delaying the generating of a second latent image of one of the first document and a second document on the member for a period of time corresponding to the value indicative of the one of the plurality of printed copy output rates; and generating the second latent image, whereby the one of the plurality of printed copy output rates is based on the time elapsed between sequential generations of the latent image of the document.

12. The method of claim 11, wherein said latent image generating step generates the latent image of the document substantially instantaneously so that the one of the plurality of printed copy output rates is substantially based solely on the elapsed time between sequential generations of the latent image of the document.

* * * * *